US006218915B1

(12) United States Patent
Schallner

(10) Patent No.: US 6,218,915 B1
(45) Date of Patent: Apr. 17, 2001

(54) DUAL-MODE RING RESONATOR

(75) Inventor: Martin Schallner, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/291,383

(22) Filed: Apr. 14, 1999

(30) Foreign Application Priority Data

Jul. 11, 1998 (DE) ..... 198 31 161

(51) Int. Cl.[7] ..... H01P 7/00; H01P 1/20
(52) U.S. Cl. ..... 333/219; 333/204
(58) Field of Search ..... 333/204, 219

(56) References Cited

U.S. PATENT DOCUMENTS 5,172,084 * 12/1992 Fiedziuszko et al. ..... 333/219
5,541,559 * 7/1996 Takahashi et al. ..... 333/204
5,684,440 * 11/1997 Yabuki et al. ..... 333/204

FOREIGN PATENT DOCUMENTS 0 844 682 A1 5/1998 (EP) .

OTHER PUBLICATIONS

Knoppik, N.: "Vergleich und Gueltigkeit Verschiedener Berechnungsverfahren der Resonanzfrequenzen . . . ", Nachrichtentechn. Z. 29 (1976) H. 2, S. 141–147.

"Stripline Dual–Mode Ring Resonator and Their Application to Microwave Devices", by Hiroyuki Yabuki, Morikazu Sagawa, et al, IEEE Transactions on Microwave Theory and Techniques, Vo. 44, No. 5, May 1996, pp. 723–729.

"Experimental Investigation of Dual–Mode Microstrip Ring Resonator", by M. Guglielmi and G. Gatti, 20–th Euroepan Microwave Conference 1990, pp. 901–906.

* cited by examiner

*Primary Examiner*—Robert Pascal
*Assistant Examiner*—Patricia T. Nguyen
(74) *Attorney, Agent, or Firm*—Michael Striker

(57) ABSTRACT

A dual-mode ring resonator including a planar conductor ring (1) of an approximately square shape with rounded corners (2,3,4,5) has a better resonator quality factor than has previously been obtained. The circumference or length of the conductor ring (1) is dimensioned so that the resonator is operated in one of its even-numbered harmonic modes.

4 Claims, 1 Drawing Sheet

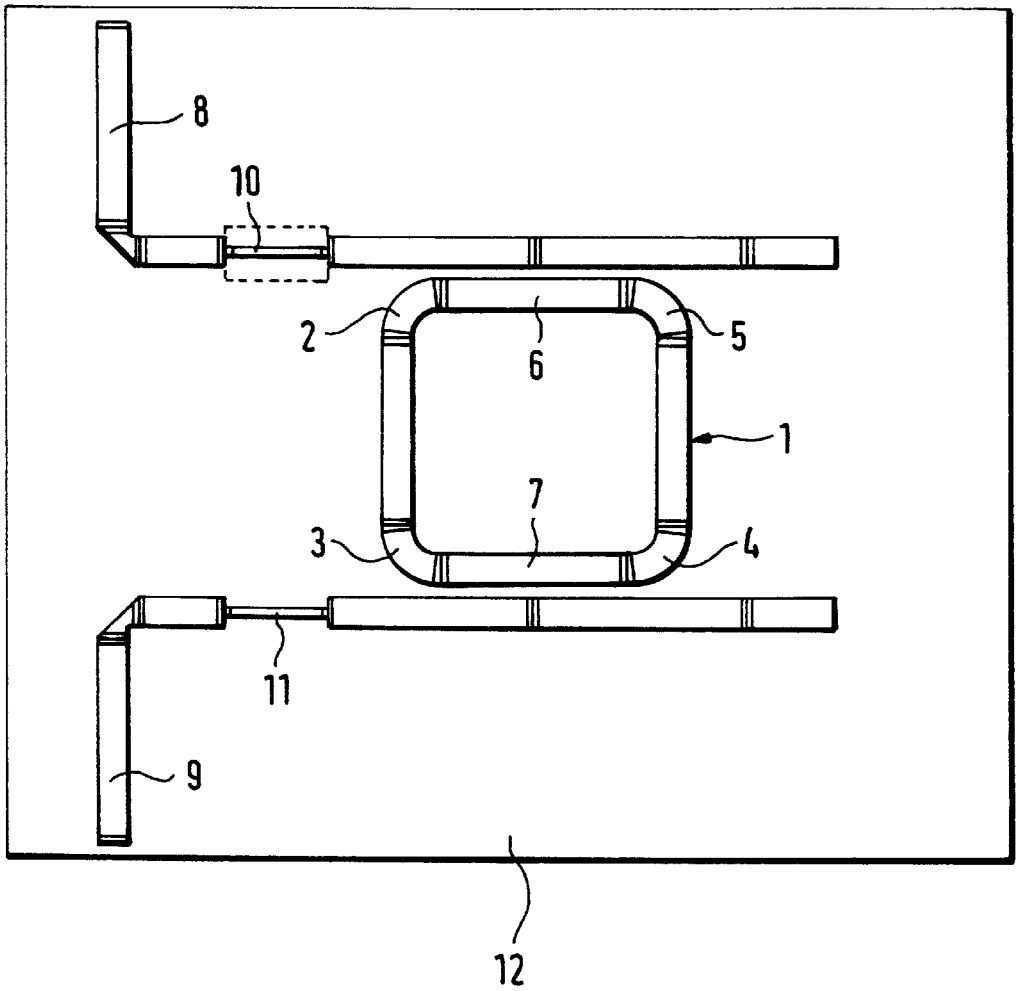
8
10
2
6
5
1
7
3
4
11
9
12

DUAL-MODE RING RESONATOR

BACKGROUND OF THE INVENTION

1. Field of the Invention

The present invention relates to a dual-mode ring resonator, which is arranged on a substrate as a planar conductor ring, to which an input conductor and an output conductor are coupled.

2. Prior Art

Dual-mode ring resonators, in which two degenerate resonance modes are excited in a conductor ring, are known from the article "EXPERIMENTAL INVESTIGATION OF DUAL-MODE MICROSTRIP RING RESONATORS", 20th European Microwave Conference 1990, pp. 901 to 906, and from IEEE TRANSACTIONS ON MICROWAVE THEORY AND TECHNIQUES, Vol. 44, No. 5, May 1996, pp. 723 to 729. These dual-mode ring resonators are, for example used as bandpass filters, which should have an attenuation that is as high as possible in their attenuation band and an attenuation that is as low as possible in their passband. It is often desirable to make the transition band between the passband and the attenuation band comparatively smaller. This means that a bandpass filter is to be provided which has passband sides that are as steep as possible. A filter characteristic with steep sides or flanks is provided with the help of the dual-mode ring resonator, because this type of resonator has attenuation or blocking poles in the vicinity of the passband edges. The known dual-mode resonators are usually operated with their fundamental frequency modes. This type of fundamental frequency mode operation occurs when the length of the conductor ring is approximately equal to a single wavelength at the desired fundamental frequency. The comparatively small length of the conductor required for the fundamental frequency operation results in a small radius of curvature of the conductor ring, which results in radiation of a comparatively larger amount of electromagnetic energy. Moreover the load caused by the coupling of the input conductor and the output conductor is very high. These properties reduce the filter quality very greatly. An additional reduction of filter quality occurs because inhomogeneities in the conductor ring are needed for coupling both modes, as can be seen from both published references mentioned hereinabove. Because of the comparatively large radiation from the ring resonator, the resonance frequency depends strongly on the spacing of the ring resonator from the cover of a housing, from which the microwave radiation is fed to the ring resonator. The resonance frequency is subjected to undesirable changes due to fluctuations of the distance of the housing cover from the ring resonator, which are caused by thermal expansion of the housing or by mechanical oscillations.

SUMMARY OF THE INVENTION

It is an object of the present invention to provide a dual-mode ring resonator of the above-described type that has as high as possible a resonator quality and thus has reduced attenuation in the passband.

These objects, and others which will be made more apparent hereinafter, are attained in a dual-mode ring resonator, which is arranged on a substrate as a planar conductor ring, to which an input conductor and an output conductor are coupled.

According to the invention the conductor ring has an approximately square shape with rounded corners and the length of, or circumference of, the conductor ring is dimensioned so that the resonator operates with one of its even-numbered harmonic modes.

Because of that the distance around the conductor ring, its circumference, can be e.g. twice, four times or six times longer than when it is operated with its fundamental mode. The curvature radius of the conductor ring is greater and the coupling of the input and output conductors to the conductor ring thus loads the resonator less, whereby its radiation is significantly reduced. As a result of that its quality factor increases. Also the effect of the spacing between the ring resonator and the housing cover on the resonance frequency is strongly reduced. The greater dimensions of the conductor ring also have the advantage that it is comparatively insensitive to manufacturing tolerances.

Preferred embodiments of the invention are described in more detail in the description hereinbelow and are claimed in the appended claims.

The input and the output conductors are coupled to respective straight conductor sections of the conductor ring that are opposite from each other across the ring in one preferred embodiment. The position of the pole over and under the passband at the filter passband edges may be adjusted in a desired manner, because of the inductive coupling.

The input conductor and the output conductor can have narrowed or widened conductor sections whose length and width are selected so that these conductors are coupled to the conductor ring in such as way that reflections are reduced as much as possible.

BRIEF DESCRIPTION OF THE DRAWING

The objects, features and advantages of the invention will now be illustrated in more detail with the aid of the following description of the preferred embodiments, with reference to the sole FIGURE which is a top plan view of a dual-mode ring resonator according to the invention mounted on a substrate.

DESCRIPTION OF THE PREFERRED EMBODIMENT

A dual-mode ring resonator which should be operated with one of its even-numbered harmonic modes is shown in the sole FIGURE. The dual-mode ring resonator comprises a conductor ring 1, which has a longer length, i.e. circumference, than a prior art ring resonator which is operated with its fundamental frequency, so that the dual-mode ring resonator of the present invention is operated with one of its even-numbered harmonic modes. For example, it may be twice as long, four times as long, six times as long as the corresponding prior art ring resonator depending on the even harmonic used in operation. The conductor ring 1 has an approximately square shape but the four corners 2,3,4 and 5 are rounded. The additional inhomogeneities for coupling between both modes of this dual-mode ring resonator can be eliminated when the conductor ring 1 is in the form of a square with rounded corners. Because of the symmetry of the ring resonator one mode forms along the straight sides and another forms over the rounded corners of the conductor ring. Because of that two different resonance frequencies arise for both modes of the resonator and the filter has a two-circuit behavior. The filter has a comparatively flat passband because of that. The bandwidth of the filter may be very simply adjusted because of its structure with the rounded corners. The more the corners are rounded, the less the difference between the resonance frequencies of both modes and the smaller is the bandwidth of the filter. In the limiting case then the approximately square shape becomes a circular shape as the corners are rounded more and more. In this latter situation both resonance frequencies approach each other.

An input conductor 8 and an output conductor 9 are coupled to respective straight conductor sections 6 and 7 of the conductor ring 1 that are located on opposite sides of the conductor ring 1. The coupling is performed in the same manner as it is for the conductor ring 1 in stripline technology. The coupling of the input conductor 8 and output conductor 9 to the conductor ring 1 is predominantly inductive. The degree of inductive coupling, which is determined by the spacing of the input and output conductors 8,9 from the conductor sections 6 and 7, has an influence on the position of the pole above and below the passband in the vicinity of the passband edges. Thus the desired position of the pole may be adjusted by means of the coupling of the input and output conductors 8 and 9 to the conductor ring 1.

The input conductor 8 and the output conductor 9 are provided with respective narrowed or thinned conductor sections 10, 11. Reflections can be very much reduced by suitable selection of the length and width of the narrowed or thinned conductor sections 10,11. However a widened conductor section can also be provided for adjustment, as indicated by the dashed lines in the drawing.

The conductor ring 1 and the input conductor 8 and the output conductor 9 coupled to it, for example, are mounted on an $Al_2O_3$ ceramic substrate 12, whose thickness amounts to 0.381 mm. Both conductor ring 1 and input and output conductors 8 and 9 have a conductor width of 0.34 mm. The average conductor length of the conductor ring 1 is about 10.6 mm at a resonance frequency of 19 Ghz. The narrowed conductor sections 10,11 are about 1.1 mm long and about 0.05 mm wide, and the coupling spacing between the input and output conductors 8,9 and the conductor ring 1 amounts to about 0.13 mm.

The disclosure in German Patent Application 198 31 161.3-35 of Jul. 11, 1998 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a dual-mode ring resonator, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims:

1. A dual-mode ring resonator comprising a planar conductor ring (1) mounted on a substrate (12), said conductor ring having an approximately square shape with rounded corners (2,3,4,5); and an input conductor (8) and an output conductor (9) arranged on said substrate so as to be coupled to said conductor ring (1);

wherein said conductor ring (1) has a circumference such that the dual-mode ring resonator operates with one of a plurality of even-numbered harmonic modes.

2. The dual-mode ring resonator as defined in claim 1, wherein said conductor ring (1) includes two straight conductor sections (6,7) coupled to said input conductor (8) and said output conductor (9) respectively, said straight conductor sections (6,7) being located on opposite sides of said conductor ring (1).

3. The dual-mode ring resonator as defined in claim 1, wherein said input conductor (8) and said output conductor (9) are inductively coupled to said conductor ring (1).

4. The dual-mode ring resonator as defined in claim 1, wherein said input conductor (8) and said output conductor (9) each include a narrowed or widened conductor section (10,11) and each of said narrowed or widened conductor section has a length and width dimensioned, whereby said input and output conductors (8,9) are coupled to the conductor ring (1) so that reflections are reduced as much as possible.

* * * * *